United States Patent [19]

Merritt

[11] 4,445,687

[45] May 1, 1984

[54] BASEBALL BAT

[76] Inventor: William H. Merritt, 350 First Ave., New York, N.Y. 10010

[21] Appl. No.: 392,386

[22] Filed: Jun. 28, 1982

[51] Int. Cl.[3] ..... A63B 59/06

[52] U.S. Cl. ..... 273/72 R

[58] Field of Search ..... 273/67 D, 67 DC, 67 DB, 273/72 R, 72 A, 67 R, 26 B, 26 C; D21/210, 211

[56] References Cited

U.S. PATENT DOCUMENTS

| | | | |
|---|---|---|---|
| 400,354 | 3/1889 | Morris | 273/72 R |
| 838,257 | 12/1906 | Kinst | 273/72 R |
| 2,169,774 | 8/1939 | Taylor | 273/72 R |
| 3,104,876 | 9/1963 | Salsinger | 273/72 |
| 3,246,894 | 4/1966 | Salisbury | 273/26 |
| 3,479,030 | 11/1969 | Merola | 273/72 |
| 3,880,423 | 4/1975 | Kreag | 273/72 R |
| 4,098,503 | 7/1978 | Antone | 273/26 B X |
| 4,331,330 | 5/1982 | Worst | 273/72 R |

FOREIGN PATENT DOCUMENTS

| | | | |
|---|---|---|---|
| 776065 | 6/1957 | United Kingdom | 273/72 A |

*Primary Examiner*—Richard C. Pinkham
*Assistant Examiner*—Matthew L. Schneider
*Attorney, Agent, or Firm*—Albert F. Kronman

[57] ABSTRACT

A baseball bat having a somewhat triangular cross-sectional shape along the ball striking portion to impart stiffness and an enlarged arcuate striking face of less curvature than conventional bats to provide more contact with the ball.

4 Claims, 3 Drawing Figures

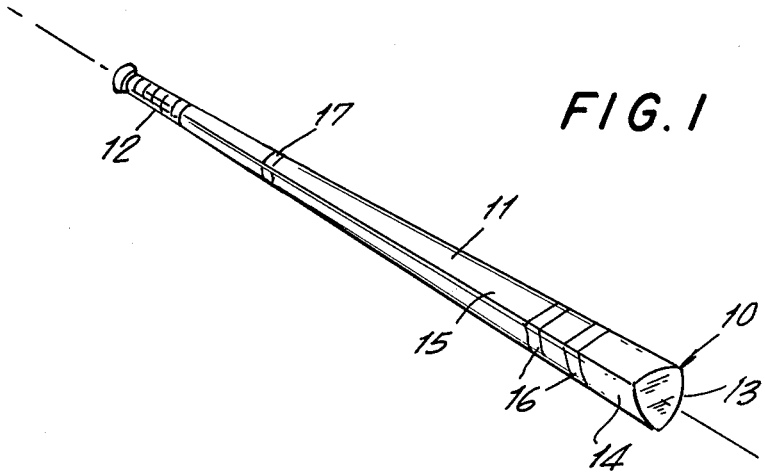
FIG. 1
FIG. 2
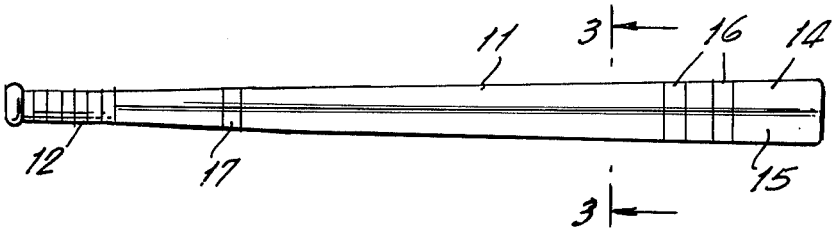
FIG. 3
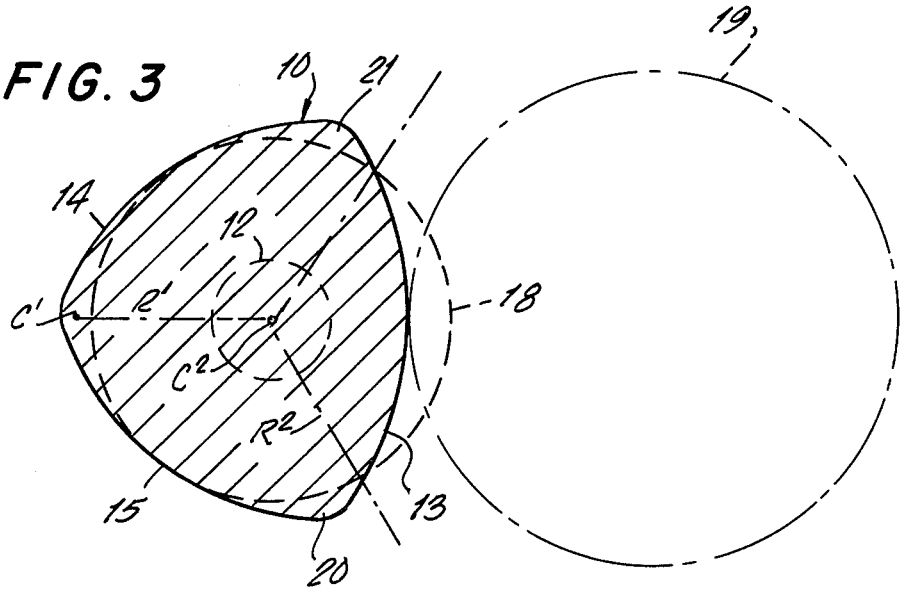

BASEBALL BAT

BACKGROUND OF THE INVENTION

Conventional baseball bats are substantially circular in cross section along their entire length and thickened at the ball striking portion, hereinafter referred to as the "head". As a result of the curvature of the bat surface, only a small portion of the head is available for good contact with the ball. Below this good contact point the ball will be driven toward the ground. Above this point there will be a "pop up" fly or foul. Since the excitement of a baseball game depends upon the number of "hits", a bat which will improve the players chance of getting a hit is desirable.

Accordingly, it is an object of the present invention to provide a baseball bat having a hitting surface on the head thereof which is less curved than that of conventional bats.

Another object of the present invention is to provide a bat which will improve the batting success of players.

A further object of the present invention is to provide a stiffer bat structure without increasing bat weight or balance.

Still another object of the present invention is to provide a bat which is compatible with present playing practices and comfortable to use.

BRIEF DESCRIPTION OF THE DRAWING

In the accompanying drawing similar parts have been given the same reference numerals, in which drawing;

FIG. 1 is a somewhat isometric view of a complete embodiment of a bat made in accordance with the present invention.

FIG. 2 is a view in side elevation of the bat shown in FIG. 1.

FIG. 3 is a cross sectional view taken on line 3—3 in FIG. 2 with certain elements shown in dashed lines for clarity.

DETAILED DESCRIPTION

Referring to the drawing, there is shown a bat 10 made of some substantially rigid material such as wood or metal. The bat comprises an elongated head portion 11 for making contact with a ball and a handle 12. The handle 12 is of conventional shape and design and need not be further described.

As will be apparent from the drawings, the bat 10 for the major portion of its length is somewhat triangular in its cross-sectional shape with the triangular sides bowed outwardly to form a front or striking surface 13 and two side surfaces 14, 15. Identification of these surfaces by the batter may be facilitated by providing bands 16 on the side surfaces 14, 15 as shown in FIGS. 1 and 2. Another band 17 may be placed around the bat to define the beginning of the handle area. The striking surface 13 is preferably unmarked.

Referring to FIG. 3 there will be seen the difference between a bat 10 as herein disclosed and a conventional bat indicated by the dashed lines 18, which is substantially circular in cross-section. The comparative cross-sectional area of the two bats is approximately the same, as shown by the sectioning, resulting in both having the same weight and feel, this is accomplished by making the chordal distance between the ends of the striking surface 13 substantially equal to the diameter of a conventional bat 18 of circular cross-section as shown in FIG. 3.

The front or striking surface 13 is generated from a much longer radius, R′ which starts at center C′, than that of a conventional bat of the same size namely $R^2$ which starts at center $C_2$. The radius R′ is preferably 2.2 to 2.6 times $R^2$. As a result, the curve of the surface 13 is much more gradual than that of other comparable cylindrical bats. The gradual curve of the surface 13 provides more contact area with the ball 19 giving the batter greater control at the moment of impact.

It has been found that a baseball will travel further if hit with a stiff bat rather than one with "whip" in it. The somewhat triangular cross-sectional shape of the herein disclosed bat serves to stiffen the bat even though the configuration caused by the large striking surface requires a certain amount of the body of the bat's head to be generated outside of the perimeter of a conventional bat of comparative size, as shown at 20, 21, in FIG. 3.

It is within the purview of the present invention to vary the taper and size of the bat in accordance with the requirement of the game since a bat used for baseball will have certain dimensions and configurations different from that used for softball, as is well-known in the art.

From the foregoing it will be seen that there has been disclosed a bat structure which will result in more hits in a game thereby adding excitement and activity for the spectators.

Having thus fully described the inventin what is claimed and desired to be secured by Letters Patent is:

1. A ball bat comprising an elongated head portion at one end and an elongated substantially cylindrical handle at the other end; said head portion having a substantially triangular cross-sectional shape; said triangular cross-sectional shape comprised of a front arcuate ball striking face and two arcuate converging sides; said front arcuate ball striking face comprising a surface in the shape of a segment of a circle generated by a radius centered about a point substantially and rearwardly removed from the geometric center of the bat to provide a head portion having a ball striking surface of more gradual curvature than a conventional bat of circular cross-sectional shape and substantially the same cross-sectional area as said conventional bat of circular cross-section, said arcuate ball striking portion being defined by a chordal distance between the ends of the said segment substantially equal to the diameter of the head portion of said conventional bat.

2. A ball bat according to claim 1 in which the head portion is tapered for at least a portion of its length with the reduced portion of its taper joined to the cylindrical handle.

3. A ball bat according to claim 1 in which the converging sides are of equal length and width to enclose, with said front arcuate ball striking face, said head portion.

4. A ball bat according to claim 1 in which the radius of the front arcuate ball striking surface is of the order of 2 to 2.6 times the radius of said conventional cylindrical bat.

* * * * *